US005908243A

United States Patent [19]

Hanning

[11] Patent Number: 5,908,243

[45] Date of Patent: Jun. 1, 1999

[54] LINERLESS SECURITY BAG

[75] Inventor: Chester L. Hanning, Charlestown, N.H.

[73] Assignee: ASB Aquisition Corp., Cincinnati, Ohio

[21] Appl. No.: 08/990,250

[22] Filed: Dec. 15, 1997

[51] Int. Cl.[6] ..... B65D 33/34

[52] U.S. Cl. ..... 383/5; 383/62; 383/66

[58] Field of Search ..... 383/62, 66, 84, 383/5

[56] References Cited

U.S. PATENT DOCUMENTS

| | | | |
|---|---|---|---|
| 3,942,713 | 3/1976 | Olson et al. | 383/66 X |
| 3,990,627 | 11/1976 | Olson | 383/62 |
| 4,410,130 | 10/1983 | Herrington | 383/62 |
| 5,046,621 | 9/1991 | Bell | 383/66 X |
| 5,056,930 | 10/1991 | Mestetsky | 383/66 X |
| 5,108,194 | 4/1992 | Raden | 383/66 X |
| 5,287,960 | 2/1994 | Kalb et al. | 383/66 X |

FOREIGN PATENT DOCUMENTS

| | | | |
|---|---|---|---|
| 9115406 | 10/1991 | WIPO | 383/66 |

*Primary Examiner*—Jes F. Pascua
*Attorney, Agent, or Firm*—Kevin Ellicott, Esq.

[57] ABSTRACT

A linerless security bag comprising a front side section and a back side section, the front and back side sections being attached to one another along at least three of four peripheral edges, the fourth peripheral edge of the back side section and front side section being unattached to one another, the front side section having a flap, the flap having impregnated thereupon an adhesive strip and a non-permanently sticking section, the flap being folded over on itself such that prior to use of the security bag the non-permanently sticking section is in contact with the adhesive strip section, the adhesive strip section strip and the non-permanently sticking section being capable of separation, the flap then being foldable such that it blocks access to an interior compartment of the security bag, the adhesive strip section contacting and permanently adhering to the front side section.

3 Claims, 2 Drawing Sheets

LINERLESS SECURITY BAG

CROSS REFERENCE TO OTHER APPLICATIONS

This is the first submission of an application for this article of manufacture. There are no other applications, provisional or non provisional.

FEDERALLY SPONSORED RESEARCH AND DEVELOPMENT

There are no federally sponsored or funded research or development projects or undertakings in any way associated with the instant invention.

BACKGROUND OF THE INVENTION

1. Field of the Invention

The instant invention relates to that field of devices consisting of articles of manufacture known as security bags. Specifically, the instant invention is a security bag having a closure flap configured to be initially releasable such that no liner is required, then permanently sealable.

2. Background Information

The prior art known to applicant discloses that permanently sealable security bags are well known. These bags are often constructed of a sheet of high strength plastic which is folded over onto itself, or from two or more separate sheets, forming opposed front and rear panels. Three of the four side edges of the plastic sheets are then sealed using heat or other sealing means to form a bag having an opening at one end. At the open end, one side of the security bag is used as a "flap" and a "receipt". The flap is eventually folded down over the opening of the bag, and sealably attached to the bag such that the bag is permanently sealed. The receipt, left unbent, is then perforated so that it may be torn off later. An example of this sort of security bag may be had by reference to U.S. Pat. No. 4,941,196, issued to Edelman et al. on Jul. 10, 1990.

Prior art bags have also been constructed as above, but additionally, they may be sealed along the fourth edge as well, and then be slit on the front or rear side. The slit provides access to the interior of the bag, the slit being located in close proximity to the flap used to seal the bag.

Unfortunately, these bags utilized a securing means, often taking the form of a strip of adhesive material, which was then over-coated with a strip of pliable material referred to within the trade as a "liner". This liner was placed over and in contact with the adhesive material to prevent that adhesive material from coming into contact with, and prematurely fastening to, the security bag.

This arrangement is satisfactory enough when security bags are used on a small scale. However, for those consumers who routinely handle large quantities of these bags, the liner presents unwanted difficulties. First, each time a bag is to be used, the liner must be removed prior to closing the bag. The user of the bag must get a finger nail, or other thin object between the liner and the adhesive strip. Once a handhold is gotten on the liner, it may be easily peeled free from the adhesive. Unfortunately, the user of the bag now finds him or herself with a useless liner strip in hand. This liner strip must now be disposed of.

As was noted above, while these difficulties are of lesser consequence to the small scale user, they can become quite burdensome to the large scale user. If many bags are to be sealed during a set period of time, the time lost on peeling each liner strip off quickly adds up. Furthermore, while it may be a simple enough matter to just throw away a few liner strips, large scale users suddenly find themselves having to dispose of great piles of these useless strips. The end result of such prior art security bags is an incredible amount of lost time, and greatly increased trash disposal costs.

SUMMARY OF THE INVENTION

The instant invention is a linerless security bag which may be easily prepared for permanent sealing. The instant invention differs significantly from the prior art in that it is easily and quickly prepared for sealing, and has no liner strip remaining as a byproduct.

The instant invention is in all relevant ways, a typical "security bag". It departs from the prior art, however, in its novel means for, and method of, closure. Whereas other bags have required the use of a liner, the instant invention does away with the liner. Instead, the instant invention utilizes the bag itself to prevent premature attachment of the bag to the adhesive material. This is accomplished by manufacturing the security bag with a non-permanently sticking strip attached directly to the flap of the security bag. The flap bearing the non-permanently sticking strip is then folded over onto itself such that the non-permanently sticking strip comes into contact with the adhesive strip which is also located on the flap.

Although the adhesive strip does in fact attach itself to the non-permanently sticking strip, it does so in a removable fashion. Therefore, when a user is ready to prepare the bag for permanent sealing, he or she need only pull the bag away from itself, and fold the flap downwardly, past the non-permanently sticking strip, and bring the adhesive strip section of the flap into direct contact with the bag, thereby permanently sealing the bag. Unlike other security bags require the addition of an adhesive by the user, the instant invention is ready to be permanently sealed the moment the adhesive strip and the non-permanently sticking strip are pulled apart from one another. The user of the instant invention also now has the option of reattaching the non-permanently sticking strip to the adhesive strip (prior to sealing the bag) in the event that the user changes his or her mind and decides to keep the bag open for a period of time. This means that the user of the bag is the person who ultimately seals the bag, whenever they choose to do so.

A DESCRIPTION OF THE DRAWINGS

A DESCRIPTION OF THE PREFERRED EMBODIMENT

Figure 1:
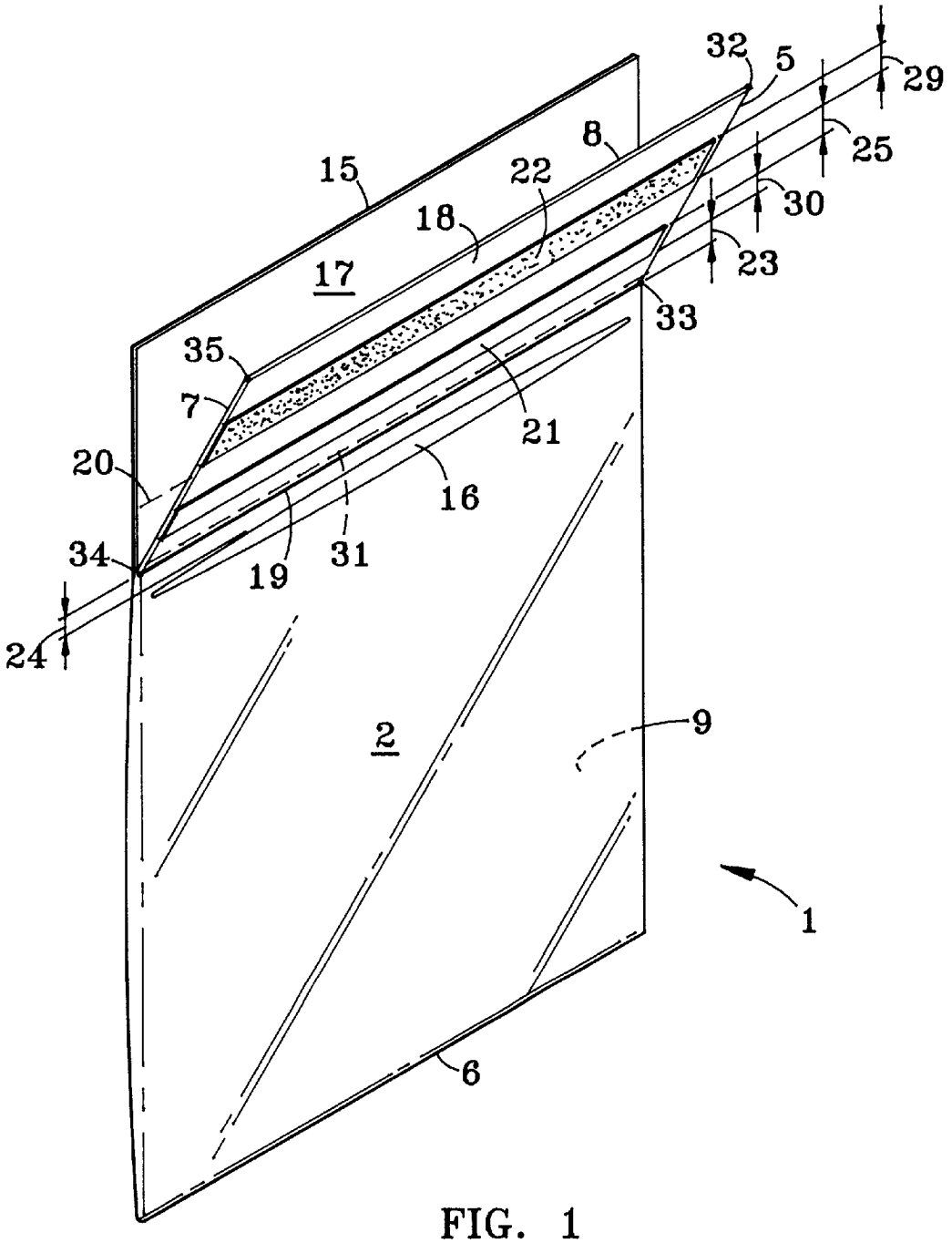
FIG. 1 is a perspective view of the linerless security bag.
Figure 2:
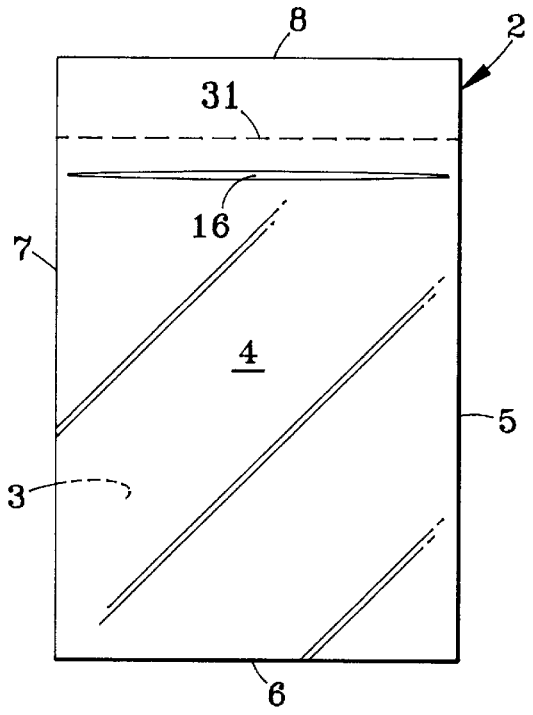
FIG. 2 is a front view of the front side section of the linerless security bag.

As per FIGS. 1 and 2, the instant invention is configured in the best mode as a flattened bag (1). As such, it has a front side section (2). The front side section has a front side section in-side (3) and a front side section out-side (4). Because the front side section is a piece of material having length, width, and depth, the front side section in-side (3) may be described as one surface of the front side section corresponding to length and width, while the front side section out-side (4) may be described as a side opposite of the front side section in-side, also corresponding to length and width, separated from the front side section in-side by front side section depth. In other words, when the three dimensional front side section is laid upon a surface, the front side section out-side will be readily apparent. In order to view the front side section in-side, one must "flip" the front side section over. The front side section further has a front side section right peripheral edge (5), a front side section bottom peripheral edge (6), a front side section left peripheral edge (7) and a front side section top peripheral edge (8). in the preferred embodiment, the front side section is constructed from a strong, clear, pliable plastic such as polyethylene.

Figure 3:
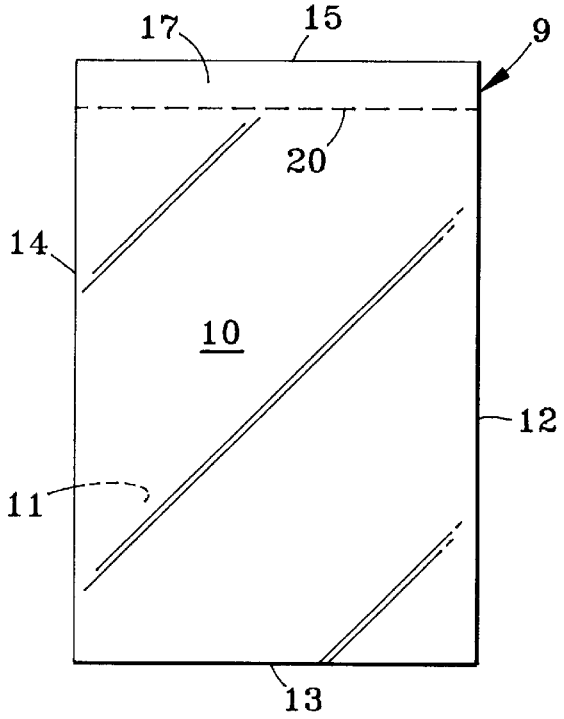
FIG. 3 is a front view of the back side section of the linerless security bag.

As per FIGS. 1 and 3, the instant invention also has a back side section (9). The back side section has a back side section in-side (10) and a back side section out-side (11). The back side section further has a back side section right peripheral edge (12) a back side section bottom peripheral edge (13), a back side section left peripheral edge (14) and a back side section top peripheral edge (15). In the preferred embodiment, the back side section is constructed from the same material as the front side.

Figure 5:
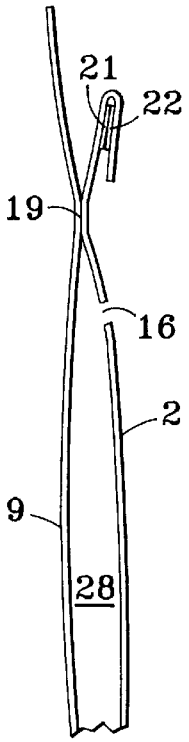
FIG. 5 is a side, cross sectional view of the upper portion of the linerless security bag with the flap folded onto itself

As per FIG. 5, the front side section has front side section thickness (26). The back side section has back side section thickness (27).

The front side section right peripheral edge, the front side section left peripheral edge, the back side section right peripheral edge and the back side section left peripheral edge define the height of the security bag.

The front side section top peripheral edge, front side section bottom peripheral edge, back side section top peripheral edge and back side section bottom peripheral edge define the width of the security bag.

In the preferred embodiment, as per FIGS. 1, 2 and 3, the front side section in-side (3) and the back side section in-side (10) are placed in contact with one another. The front side section and the back side section are then permanently attached to one another along their peripheral edges. The front side section right peripheral edge (5) is attached to the back side section right peripheral edge (12). The front side section left peripheral edge (7) is attached to the back side section left peripheral edge (14). The front side section bottom peripheral edge (6) is attached to the back side section bottom peripheral edge (13).

Figure 4:
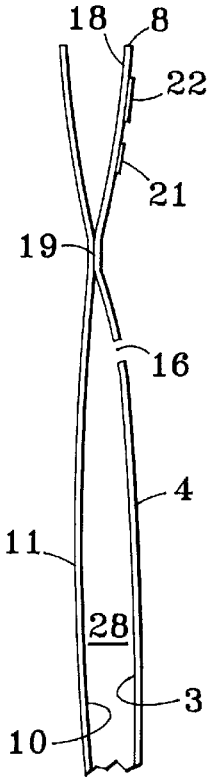
FIG. 4 is a side, cross sectional view of the upper portion of the linerless security bag.

As per FIG. 1, the preferred embodiment includes a security bag interior access opening (16). The security bag interior access opening passes through both the front side section in-side (3) and the front side section out-side (4). As per FIGS. 4, 5 and 6, the security bag interior access opening provides access to an interior compartment (28) defined by front side section in-side, the back side section in-side, and the permanently attached peripheral edges.

As per FIG. 1, in the preferred embodiment, the front side section top peripheral edge (8), and the back side section top peripheral edge (15) are not attached to one another. Unlike the side peripheral edges and the bottom peripheral edge, the front side section top peripheral edge and the back side section top peripheral edge are left unattached. The top end of the security bag is permanently closed, along a top end attachment area (19), which extends from the front side section left peripheral edge/back side section left peripheral edge to the front side right peripheral edge/back side right peripheral edge. The top end attachment area (19) is locatable between the back side section top peripheral edge/front side section top peripheral edge and the security bag interior access opening (16), parallel to the front side section bottom peripheral edge (6).

In the preferred embodiment, the front side, section and the bottom side section are attached to one another along their peripheral edges utilizing a heat seal, to wit; applying heat along the edge, thereby melting the front side section and the back side section together permanently.

Although the instant invention is described as being composed of two separate sheets of material, it may just as easily be constructed from one sheet which is then folded over upon itself. In that case, the front side section bottom peripheral edge and the back side section bottom peripheral edge are one and the same. Furthermore, while the instant invention has been described as having its front side section and its bottom side section heat sealed together, any other means for permanently, sealably connecting the sections, such as by the use of a bonding agent such as glue, would be acceptable.

Furthermore, as per FIGS. 1 and 3, it may be desirable to perforate the back side section in a line (20), parallel to the back side section top peripheral edge (15), said perforations being locatable below the back side section top peripheral edge (15) and above the top end attachment area (19), in order to make removal of a receipt (17) simpler. The receipt being the area of the back side section which is locatable between the top end attachment area (19) and the back side section top peripheral edge (15). In the trade, this section is often imprinted with identifying information and may be torn off and retained by the user as a record.

As per FIG. 1, a flap (18) may be defined as the area of the front side section locatable between the top end attachment area (19) and the front side section top peripheral edge (8). Although a front side section flap right peripheral edge is but a section of the front side section right peripheral edge, a flap top peripheral edge is coextensive with the front side section top peripheral edge, and a flap left peripheral edge is but a section of the front side left peripheral edge, it is useful for understanding's purposes to recognize that the flap right peripheral edge is begins at a first point (33) where the top end attachment area (19) and the front side section right peripheral edge (5) meet, and continues, coextensive with the front side section right peripheral edge to a second point (32) where the front side section right peripheral edge and the front side section top peripheral edge meet. The front side section flap top edge begins at the second point (32) and continues, coextensive with the front side section top peripheral edge to a third point (35). The front side section flap left edge begins at the third point (35) and continues, coextensive with a section of the front side section left peripheral edge to a fourth point (34). The flap (18) constitutes a primary structural component of the novel linerless seal.

As per FIGS. 1, 4, 5 and 6, the flap (18) has attached thereupon an adhesive strip section (21). The adhesive strip section is locatable between the front side section top peripheral edge (8) and the top end attachment area (19). The adhesive strip section extends from the front side section right peripheral edge (5) to the front side section left peripheral edge (7).

As per FIGS. 1, 4, 5 and 6, the flap (18) has attached thereupon a non-permanently sticking strip (22). The non-permanently sticking strip is locatable between the front side section top peripheral edge (8) and the adhesive strip section (21). The non-permanently sticking strip (22) extends from the front side section right peripheral edge (5) to the front side section left peripheral edge (7).

Although in the preferred embodiment the non-permanently sticking strip (22) is locatable between the front side section top peripheral edge (8) and the top end attachment area (19), while the adhesive strip section is locatable between the non-permanently sticking strip (22) and the top end attachment area (19), it would be equally satisfactory to reverse the locations of the non-permanently sticking strip and the adhesive strip section such that the non-permanently sticking strip was locatable between the adhesive strip section and the top end attachment area instead.

In the preferred embodiment, the non-permanently sticking strip is a strip of silicone which is permanently applied onto the front side section out-side (4). Furthermore, a non-permanently sticking strip height (29) is at least as high, and preferably higher than, an adhesive strip section height (30). In the preferred embodiment, the adhesive strip section is approximately one half of one inch high. While the preferred embodiment utilizes silicone for the non-sticking strip, any material which may be permanently attached to the front side section out-side, yet will not bind permanently to the adhesive strip section, may be utilized.

In the preferred embodiment, the adhesive strip section is applied as a liquid onto the front side section, the liquid adhesive bonding to the front side section, yet remaining sufficiently tacky after drying so that when the adhesive strip section comes in contact with the front side section out-side, the flap permanently adheres to the front side section out-side. It should be recognized that while the preferred embodiment applies the adhesive strip section as a liquid, the device will function equally well with any method for attaching the adhesive strip section, including but not limited to mechanical attachment, chemical attachment and electrical attachment, so long as the adhesive strip is capable of permanently adhering to the bag and to the flap.

In the preferred embodiment of the device, as per FIG. 1, the flap (18) is structurally weakened to better accommodate folding (the fold to be locatable parallel to the front side section top peripheral edge). This is accomplished by what is known in the trade as a "fold perforation" (31). The fold perforation (31) does not pass through both the front side section in-side and the front side section out-side. Instead, the material is "scored" in a line extending from the front side section right peripheral edge to the front side section left peripheral edge. This scoring may be accomplished using heat, chemical or mechanical means. Although a fold perforation is desirable, it is not a requirement.

When constructing the instant invention, a distance (23) between the top end attachment area (19) and the adhesive strip section (21) should be wider than a distance (24) between the top end attachment area (19) and the security bag interior access opening (16). This permits the flap (18) to be folded over and the bag to be permanently sealed.

As per FIG. 5, prior to use by the security bag user, the flap (18) is folded over onto itself such that the non-permanently sticking strip (22) and the adhesive strip section (21) are in contact with one another, along their entire lengths. As per FIG. 1, in order for the contact between the non-permanently sticking strip (22) and the adhesive strip section (21) to be possible, it is necessary that there be sufficient distance (25) between the adhesive strip section (21) and the non-permanently sticking strip (22). Furthermore, in the preferred embodiment, while the non-permanently sticking strip and the adhesive strip section both extend to approximately the right and left peripheral edges, As per FIG. 4, when the security bag user is prepared to use the bag, he or she will peel lose the non-permanently sticking strip (22) from the adhesive strip section (21) so that the adhesive strip section (21) is fully exposed.

Figure 6:
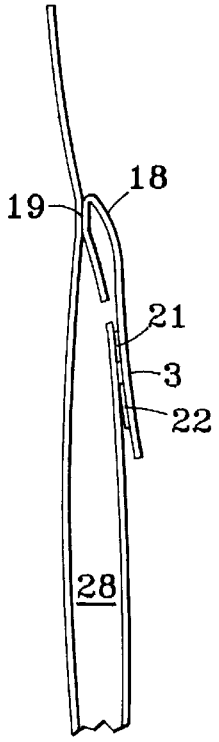
FIG. 6 is a side, cross sectional view of the upper portion of the linerless security bag with the flap folded over onto the front side section.

As per FIG. 6, the security bag user then folds the flap downwardly, toward the front side section bottom peripheral edge, so that the adhesive strip section (21) is placed between the security bag interior access opening (16) and the front side section bottom peripheral edge. The security bag user may then press along the front side section in-side, along the adhesive strip section (21), thereby completely blocking access to the security bag interior access opening, securely and permanently sealing the bag.

The instant invention is capable of various manifestations, dependent upon the configuration of the security bag. For example, the bag may be sealed along all peripheral edges, with access to the security bag interior compartment (28) being provided by the security bag interior access opening. In this case, the flap (18) may be locatable on the front side section (as in the preferred embodiment), or may instead be an extension of the back side section. In either case, the distance between the first point (33) and the second point (32) as well as the third point (34) and the fourth point (35) must be sufficiently great enough such that the adhesive strip section (21) may attach to the front side section along an area locatable between the security bag interior access opening (16) and the front side section bottom peripheral edge (6).

The instant invention may also be utilized on security bags which have no top end attachment area (19) and no security bag interior access opening (16). When configured in this manner, the security bag interior compartment may be accessed through an opening provided by the unsealed top peripheral edge. In such a configuration, as with the aforementioned configuration, the flap (18) may extend from the back side section (13) rather than from the front side section. In this case, the height of the back side section right peripheral edge and back side section left peripheral edge will be greater than the height of the front side section right peripheral edge and the front side section left peripheral edge. In this configuration the flap seals the security bag by being folded down onto the front side section outside (4) such that the flap (18) blocks entry into the security bag interior compartment.

It should be understood that while the preferred embodiment discloses a bag having the flap located along a top edge, it is equally satisfactory to locate the flap along a side edge instead.

I claim:

1. A linerless security bag comprising;

A. a front side section,

I. the front side section having a front side section in-side and a front side section out-side, II. the front side section having a front side section right peripheral edge, III. the front side section having a front side section bottom peripheral edge, IV. the front side section having a front side section left peripheral edge, V. the front side section having a front side section top peripheral edge, VI. the front side section having a security bag interior access opening, a. the security bag interior access opening beginning in close proximity to the front side section left peripheral edge and extending to within close proximity of the front side section right peripheral edge, b. the security bag interior access opening passing completely through the front side section out-side and passing completely through the front side section in-side, thereby permitting the communication of materials through the front side section;

B. a back side section,

I. the back side section having a back side section right peripheral edge, a. the back side section right peripheral edge being attached to the front side section right peripheral edge, II. the back side section having a back side section bottom peripheral edge, a. the back side section bottom peripheral edge being attached to the front side section bottom peripheral edge, III. the back side section having a back side section left peripheral edge, a. the back side section left peripheral edge being attached to the front side section left peripheral edge, IV. the back side section having a back side section top peripheral edge, V. the back side section having a back side section in-side and a back side section out-side, a. the back side section in-side and the front side section in-side being securely attached to one another along a top end attachment area, i. the top end attachment area extending from the back side section right peripheral edge to the back side section left peripheral edge, parallel to the back side section bottom side and the front side section top side, ii. the top end attachment area being locatable between the security bag interior access opening, and the front side section top peripheral edge;

C. a flap,

I. the flap having a flap right peripheral edge, a. the flap right peripheral edge extending from and being continuous with the front side section right peripheral edge, b. the flap right peripheral edge beginning at the point where the top end attachment area and the front side section right peripheral edge meet, c. the flap right peripheral edge being unattached to the back side section right peripheral edge, d. the flap right peripheral edge merging into and becoming one with the front side section top peripheral edge at a point most distant from the front side section bottom peripheral edge, II. the flap having a flap left peripheral edge, a. the flap left peripheral edge extending from and being continuous with the front side section left peripheral edge, b. the flap left peripheral edge beginning at the point where the top end attachment area and the front side section left peripheral edge meet, c. the flap left peripheral edge being unattached to the back side section left peripheral edge, d. the flap left peripheral edge merging into and becoming one with the front side section top peripheral edge at a point most distant from the front side section bottom peripheral edge, III. the flap having a flap front side, a. the flap front side merging into and being continuous with the front side section out-side, b. the flap front side having impregnated thereupon a non-permanently sticking strip, i. the non-permanently sticking strip extending from the front side section left peripheral edge to the front side section right peripheral edge, c. the flap front side having impregnated thereupon an adhesive strip section, i. the adhesive strip section extending from the front side section left peripheral edge to the front side section right peripheral edge, IV. the flap having a flap back side, a. the flap back side merging into and being continuous with the front side section in-side, D. an interior compartment, I. the interior compartment being definable as the space between the front side section in-side and the back side section in-side, II. the interior compartment being bounded by the front side section right peripheral edge and the back side section right peripheral edge, III. the interior compartment being bounded by the front side section bottom peripheral edge and the back side section bottom peripheral edge, IV. the interior compartment being bounded by the front side section left peripheral edge and the back side section left peripheral edge, V. the interior compartment being bounded by the top attachment area.

2. The linerless security bag of claim 1, wherein a method for utilizing the flap comprises;

A. folding the flap over onto itself such that the adhesive strip section and the non-permanently sticking strip are in contact with one another, B. peeling the non-permanently sticking strip from the adhesive strip section such that the adhesive strip section is exposed, C. folding the flap onto the security bag such that the adhesive strip section is in contact with the security bag, the flap blocking entry into the interior compartment.

3. A linerless security bag comprising;

A. a front side section,

I. the front side section having a front side section in-side and a front side section out-side, II. the front side section having a front side section right peripheral edge, III. the front side section having a front side section bottom peripheral edge, IV. the front side section having a front side section left peripheral edge, V. the front side section having a front side section top peripheral edge, B. a back side section, I. the back side section having a back side section right peripheral edge, a. the back side section right peripheral edge being longer than the front side section right peripheral edge, a. the back side section right peripheral edge being attached to the front side section right peripheral edge, II. the back side section having a back side section bottom peripheral edge, a. the back side section bottom peripheral edge being attached to the front side section bottom peripheral edge, III. the back side section having a back side section left peripheral edge, a. the back side section left peripheral edge being longer than the front side section left peripheral edge, b. the back side section left peripheral edge being attached to the front side section left peripheral edge, IV. the back side section having a back side section top peripheral edge, V. the back side section having a back side section in-side and a back side section out-side, C. a flap, I. the flap having a flap right peripheral edge, a. the flap right peripheral edge extending from and being continuous with the back side section right peripheral edge, b. the flap right peripheral edge being unattached to the front side section right peripheral edge, c. the flap right peripheral edge merging into and becoming one with the back side section top peripheral edge at a point most distant from the back side section bottom peripheral edge, II. the flap having a flap left peripheral edge, a. the flap left peripheral edge extending from and being continuous with the back side section left peripheral edge, b. the flap left peripheral edge being unattached to the front side section left peripheral edge, c. the flap left peripheral edge merging into and becoming one with the back side section top peripheral edge at a point most distant from the back side section bottom peripheral edge, III. the flap having a flap front side, a. the flap front side merging into and being continuous with the back side section in-side, b. the flap front side having impregnated thereupon a non-permanently sticking strip, i. the non-permanently sticking strip extending from the back side section left peripheral edge to the back side section right peripheral edge, c. the flap front side having impregnated thereupon an adhesive strip section, i. the adhesive strip section extending from the back side section left peripheral edge to the back side section right peripheral edge, IV. the flap having a flap back side, a. the flap back side merging into and being continuous with the back side section out-side, D. an interior compartment, I. the interior compartment being definable as the space between the front side section in-side and the back side section in-side, II. the interior compartment being bounded by the front side section right peripheral edge and the back side section right peripheral edge, III. the interior compartment being bounded by the front side section bottom peripheral edge and the back side section bottom peripheral edge, IV. the interior compartment being bounded by the front side section left peripheral edge and the back side section left peripheral edge, V. the interior compartment being bounded by the top attachment area.

* * * * *